United States Patent [19]

McKee et al.

[11] 4,127,316

[45] Nov. 28, 1978

[54] CABLE CLAMP CONSTRUCTION

[75] Inventors: William H. McKee, West Covina, Calif.; Roy Witte, Rolling Meadows, Ill.

[73] Assignee: TRW Inc., Elk Grove Village, Ill.

[21] Appl. No.: 797,588

[22] Filed: May 16, 1977

[51] Int. Cl.[2] ..... H01R 13/58

[52] U.S. Cl. ..... 339/103 R; 24/257; 339/91 R

[58] Field of Search ..... 339/103 R, 107, 91 R; 24/257 R

[56] References Cited

U.S. PATENT DOCUMENTS

| | | | |
|---|---|---|---|
| 3,286,963 | 11/1966 | Bergman | 24/257 R |
| 3,739,435 | 6/1973 | Baker | 24/257 R |
| 3,951,501 | 4/1976 | Bauerle et al. | 339/91 R |
| 4,035,051 | 7/1977 | Guy | 339/103 R |

*Primary Examiner*—Roy Lake
*Assistant Examiner*—DeWalden W. Jones
*Attorney, Agent, or Firm*—Neuman, Williams, Anderson & Olson

[57] ABSTRACT

A deformable cable clamp for use with various ribbon connectors is readily mountable on a connector end portion to conveniently clamp a cable of wires in position prior to application of a cover or hood. The provided clamp enables the wire terminations to be effected either prior to or after the cable from which the wires emanate is secured in place by the clamp. The clamp is readily engaged with the cable by a simple bending step to effect a strain-free relationship between the cable wires and connector contacts. The simplicity of the construction provided lends itself particularly well to automated assembly operations.

14 Claims, 12 Drawing Figures

FIG. 1
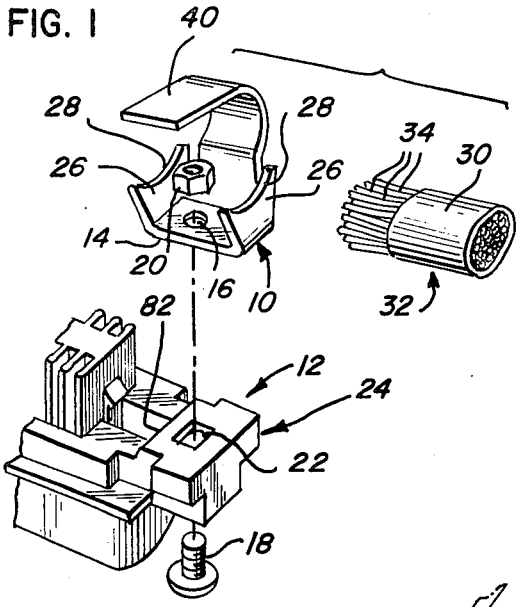
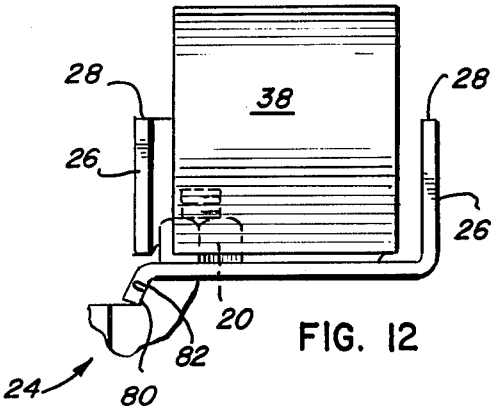
FIG. 12
FIG. 2
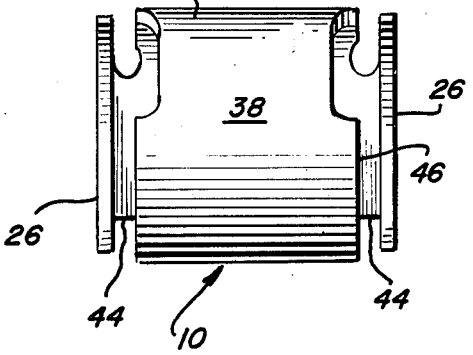
FIG. 3
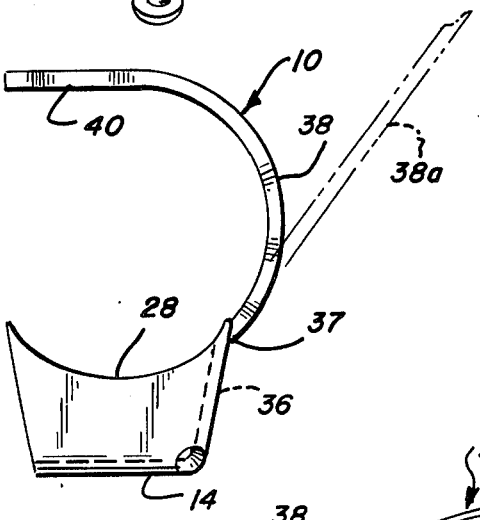
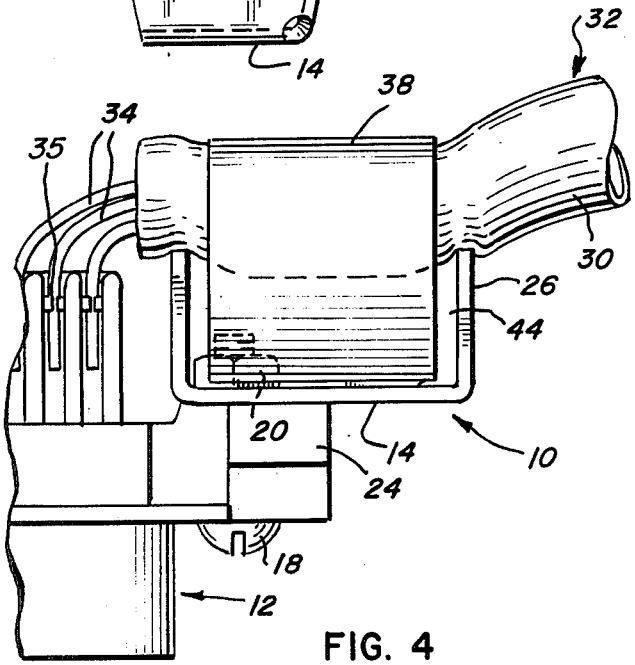
FIG. 4
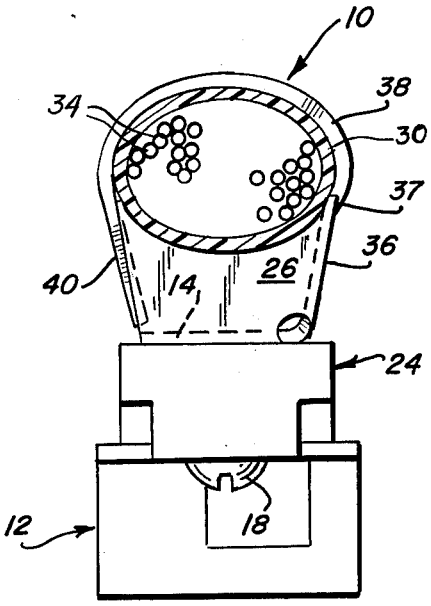
FIG. 5

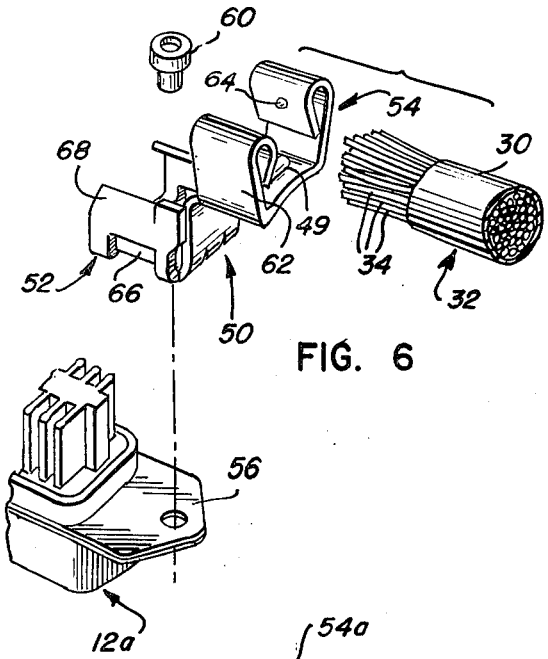
FIG. 6
FIG. 7
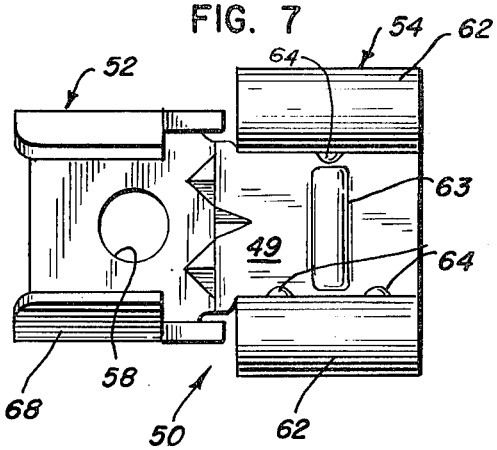
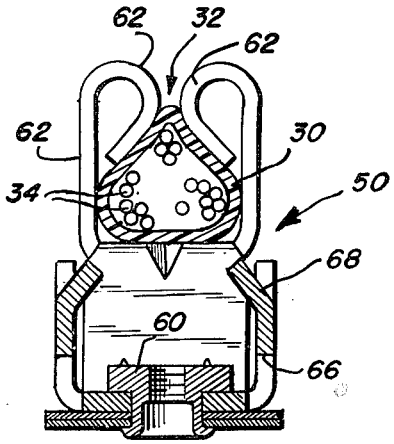
FIG. 8
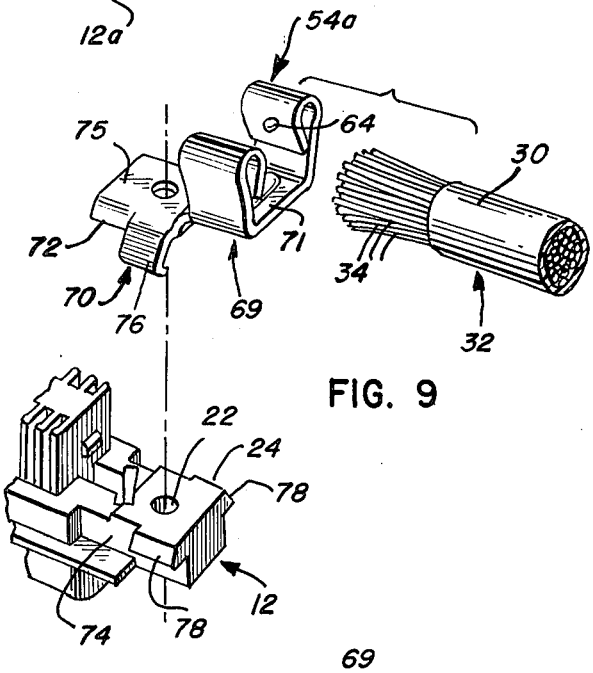
FIG. 9
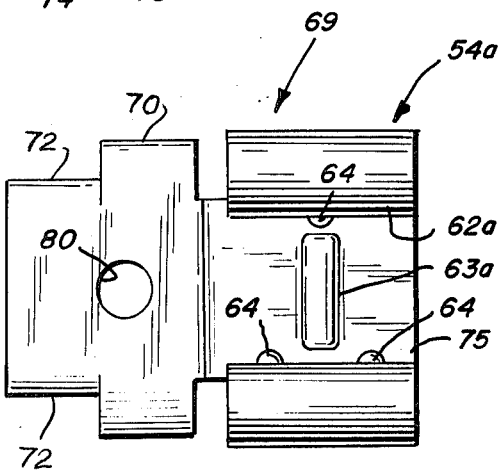
FIG. 10
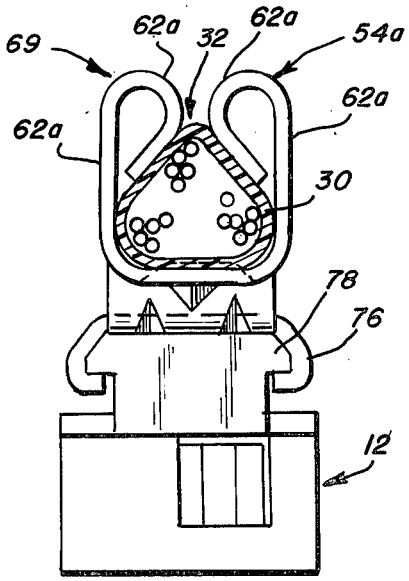
FIG. 11

CABLE CLAMP CONSTRUCTION

This invention relates to a novel cable clamp construction and more particularly pertains to a discrete cable clamp construction adapted to be readily secured to a multi-wire connector.

The use of cable clamps with electrical connectors is well-known in the art. The clamp construction hereinafter discussed in detail is particularly adapted for use with ribbon-type connectors and termination systems known in the art as miniature ribbon termination systems, or high density systems in which a plurality of wires are terminated in closely adjacent relationship. The wires which are terminated in such connectors may be terminated by various means including solder-employing or solderless techniques.

As is also well-known in the prior art, following termination of a plurality of wires in a ribbon-type connector, a cover or hood construction may envelop such connector with the wires terminated therein. Such hoods encompass the wires and wire-contact terminations for purposes of protecting against inadvertent electrical contact with other objects, i.e., electrical short circuits, and against dirt contamination and for similar protective reasons.

Often the cable clamp was an integral part of the hood, clampingly engaging the cable from which the terminated wires emanated when the hood was applied. The cable clamp portion of the hood fixedly positioned a cable portion relative to the hood and connector so as to prevent any forces exerted on the cable from disturbing the terminations between the connector contact elements and the engaged wires thereby serving as a strain relief for the wire-contact terminations.

Exemplary prior art includes Steinbach U.S. application Ser. No. 672,643, filed Apr. 1, 1976 which discloses the use of a connector hood construction having a cable clamp integrally formed therewith. The Steinbach hood readily snaps into interlocking engagement with cooperative ribbon connectors for purposes of protectively covering the terminated wires. A connector cover construction having a strain relief device integrally formed therewith is disclosed in Ayer U.S. Pat. No. 3,876,276.

Many of the prior art cable clamp devices in commercial use also required the separate application of screws, bolts, straps or other separate securing devices.

It will be noted that the connector contacts having the wires terminated therein typically are covered and hidden from view by a protective hood when such a hood is applied. In the normal course of hood use with the aforementioned prior art devices, the wires first are secured in electrical engagement with the connector metal contacts, whereafter the hood is applied. Clamp portions integrally formed with the hood then are clampingly engaged with the end of the cable sheath from which the wires extend for purposes of providing a strain relief function, and securing devices are applied.

By virtue of the very nature of the cover and hood constructions of the prior art, at the time the strain relief clamp is secured to the cable, the terminations between the wires and connector contacts cannot be visually inspected. As a result, it is uncertain as to whether all terminations are proper at the time the cable is engaged to the strain relief portion of the cover or hood.

In many applications, a hood construction is not necessary for purposes of enveloping the terminated wires in a connector although it is desired to provide a strain relief device to prevent breaking of contacts between wires and contact elements of the connector. Such strain tending to break such contacts may be expected as when forces may be exerted from time to time on the cable from which the wires extend. Thus, termination strain protection may be desired although the environment in which the cable and connector are disposed is such that there is no necessity for a hood to guard against contact with potentially damaging elements.

Accordingly it is an object of this invention to provide an improved, simplified cable clamp construction readily mountable on a connector end portion.

It is a further object to provide a clamp which enables wire terminations to be effected, with connector contacts, either before or after the cable sheath from which the wires extend is secured in place in a strain-free relationship with respect to the connector contacts by the clamp attachment.

It is a further object of this invention to provide a cable clamp device of simple construction which may be mounted on an end portion of a connector and which readily clamps a cable by a simple operation, without requiring separate fasteners and particularly which may be clamped onto a cable by a simple closing action of a pliers or automated tool or the like.

It is a further object of this invention to provide a simplified cable clamp construction in which the contacts effected between the terminated wires and the connector contacts may be always visually examined or, if desired, a protective hood construction may be applied thereover after the connections or terminations between the contacts and the wires have been visually examined and the strain relief clamp has been secured in operative position.

The above and other objects of this invention will become more apparent from the following detailed disclosure when read in the light of the accompanying drawings and appended claims.

In one embodiment of the provided clamp construction an integral clamp element is provided composed of a readily deformable and bendable soft steel composition. The clamp comprises an element adapted to retain its clamping configuration after bending and deformation thereof, and a base portion adapted to be anchored to an end portion of a ribbon connector with which the clamp is adapted to be used by securing means such as nut and bolt assemblies and the like. A deformable portion or portions extend from said base to receive an electrical cable adjacent thereto and to be bent into engaging relation with a peripheral portion of the cable thereby retaining such cable in relatively immovable relation thereto. The resulting connector-clamp combination may be enveloped by a protective hood.

It is apparent that at the time that a hood is applied to connector-clamp combinations assembled pursuant to this invention, the cable clamp will be in its fixed relationship with the connector, and the wires extending from the clamped cable will have been terminated and be strainfree. The resulting combination, having the termination elements thereof in desired, visually examinable, relationship, is then encompassed by the hood member.

For a more complete understanding of this invention reference will now be made to the drawings wherein:

FIG. 1 is an exploded view illustrating a clamp made in accordance with this invention, a fragmentary end portion of the connector on which the clamp is to be mounted and a fragment of a cable member to be engaged by the clamp element illustrated;

FIG. 2 is a top plan view of the clamp illustrated in FIG. 1 and depicted on an enlarged scale;

FIG. 3 is an end view of the clamp of FIG. 1 illustrated on a scale enlarged thereover depicting in phantom lines a modified wall configuration;

FIG. 4 is a side elevational view of the elements of FIG. 1 in the normal position of assembly and illustrated on an enlarged scale;

FIG. 5 is an end elevational view of the assembly of FIG. 4, with the cable shown in section;

FIG. 6 is an exploded view similar to FIG. 1 illustrating another clamp construction also employing teachings of this invention, with a fragment of a connector having a metal shell, prior to being assembled;

FIG. 7 is a top plan view of the clamp of FIG. 6 and illustrated on a scale enlarged thereover;

FIG. 8 is an end elevational view partly in section illustrating the elements of FIG. 6 in a state of assembly;

FIG. 9 is an exploded view similar to that of FIG. 6 illustrating a connector which is of plastic construction and a cable clamp construction modified over that illustrated in FIG. 6 in that it is particularly adapted to securely engage the all-plastic connector illustrated in FIG. 9;

FIG. 10 is a top plan view of the clamp of FIG. 9 and illustrated on a scale enlarged thereover;

FIG. 11 is an end elevational view of the elements of FIG. 9 in the state of assembly; and FIG. 12 is a side elevational view illustrating a clamp similar to that illustrated in FIGS. 1 through 5 but having a depending lip portion for purposes of effecting a more secure mounting engagement with the connector end portion fragmentarily illustrated.

Referring now more particularly to FIG. 1 a clamp 10 made in accordance with this invention comprising a strain relief device is illustrated prior to assembly to an end portion of a miniature ribbon-type connector 12. The connector 12 is of the type manufactured by TRW, Inc. of Elk Grove Village, Ill. and identified as a Cinch Ribbon or a Superibbon Connector. Connectors of the general type illustrated are produced by other manufacturers and are adapted to be employed in so-called miniature termination systems or high density systems in which a plurality of wires are terminated in closely adjacent relationship. Although the illustrated connector 12 is of all-plastic construction with the exception of the wire terminals therein such as the aforementioned Superibbon connector, the provided clamp of this invention is also adapted to be employed with ribbon connector constructions such as connector 12*a* illustrated in FIG. 6 having a metal shell.

The clamp 10 has a planar base portion 14 having a substantially centrally disposed aperture 16. The latter is adapted to permit passage of a securing means such as illustrated bolt 18 which is adapted to engage a nut 20 after the shank of the bolt has traversed aperture 16 disposed in end portion 24 of the connector 12.

Integrally formed with opposed ends of the clamp base portion 14 are clamp end walls 26 disposed at substantially right angles thereto as is most clearly seen from FIG. 4. It will also be noted from the latter figure that in the normal position of assembly of the clamp 10 on end portion 24 of connector 12, the base 14 is in substantial axial alignment with the axis of the connector.

The upper edges of each clamp end wall are preferably arcuately formed as illustrated at 28 (FIG. 3) so as to serve as a receiving "saddle" surface for an annular peripheral portion of sheath 30 of cable 32 containing a plurality of wires 34 to be terminated in metal contacts 35 of the connector 12 in the manner more clearly seen in FIG. 4.

Interposed the clamp end walls 26 and integrally formed with a longitudinal edge of the clamp base portion 14 is a planar side wall 36 which as is more clearly seen in FIG. 3, may define an obtuse angle therewith as illustrated, although the specific angular relationship between the side wall 26 and the base 14 may vary from that illustrated. Integrally formed with upper edge portion of the planar side wall 36 is an arcuate intermediate portion 38 adapted to effect a substantial area of contact with the periphery of a cable member such as the periphery of sheath 30 of cable 32 illustrated in FIG. 1. The intermediate wall portion 38 is integrally formed with a distal terminal planar portion 40, see FIG. 3. When portion 40 is urged into its final position of use, it is disposed relative to the base portion 14 at approximately the same obtuse angle as side wall planar portion 36 oppositely disposed thereto, see FIG. 5.

At least the portion 38, and preferably the entire clamp, is formed of a deformable or ductile material of substantial strength but with low elastic memory, such as the low carbon steel referred to below, to effect permanent clamping engagement of the cable upon forceful deformation of the portions 36, 38, 40 thereagainst.

In the normal course of use, clamp 10 is secured to a connector end portion such as end portion 24 of connector 12 illustrated in FIG. 1. A cable portion near one end of the cable is then inserted adjacent intermediate wall portion 38 so that spaced sheath portions of such cable rest upon the spaced upper edges 28 of the end walls 26. Such cable positioning may be effected after individual wires 34 extending from the cable nested portion have been terminated in the contacts 35 of the connector. In an alternate method of assembly, the cable first may be fixedly positioned relative to the clamp 10, after which the wire terminations may be effected. In either event, the clamping may be effected by means of a hand tool, or automatically by means of closing or clamping means.

Thus, following location of a cable portion on the spaced wall arcuate edges 28, a tool such as a pliers or the like may be employed to urge arcuate wall portions 38 and distal clamp portion 40 to pivot about juncture 37 defining the transitional point between planar side wall 36 and arcuate clamp portion 38. The clamp portions 38 and 40 are urged into the position of FIG. 4, wherein the clamp portion 40 is disposed in close proximity to an edge of the clamp base portion 14 oppositely disposed to the juncture between the base and opposed planar clamp portion 36. The arcuate wall portion 38 is also deformable in this clamping step to snugly wrap about the periphery of the cable 32, simultaneously deforming the same.

As the arcuate clamp portion 38 is urged about juncture 37, the underlying portion of the cable sheath is engaged and deformed at its points of support on the spaced arcuate edges 28 in the manner illustrated in FIG. 4. It will be noted from this latter figure that the opposed edges actually dig into the soft plastic sheath 30 of cable 32 and the lower cable wires 34 are forced beneath the level of surfaces 28, preventing relative movement between the clamp and cable upon exertion of an axial force along the cable axis. It will be apparent from FIG. 5 of the drawing that the clamping effect of arcuate portion 38 is adequate to deform the cable 32 from its normal circular configuration to the oval configuration illustrated.

Although intermediate side wall portion 38 is illustrated as arcuate in configuration, wall portion 38 and terminal portion 40 may comprise a continuous planar strip 38*a* fragmentarily illustrated in phantom lines in FIG. 3 and connected at 37 to side wall portion 36. The ductile nature of such planar strip will enable the same to be deformably wrapped about a cable periphery and define a final configuration substantially the same as that shown in FIG. 5 as the distal end of strip 38*a* is pivoted downwardly. Since portion 38*a* must be deformed in the course of engaging the cable periphery, the force applied will exceed that employed with arcuate wall portion 38.

The clamp of this invention requires no separate securing or latching means such as a screw, bolt, strip or the like for assuring engagement between the clamp and the cable to be fixed in position. The cable securing means is an integral part of the clamp.

The provided clamp requires no special tools to deform the clamping element thereof into operative position, a simple pliers being adequate in hand operation. Also, as above described, the particular configuration of the clamping side wall portion is not of critical importance.

The simple clamp construction described particularly lends itself to automated assembly of cable and connectors. Because of the absence of discrete securing means for locking the clamp to the engaged cable, the clamp-cable assembly step is obviously simplified. Thus, in an automated or semi-automated assembly process, the cable sheath end from which the wires emanate may be placed in a clamp already mounted on a connector disposed in a jig. A simple tool movement may readily deform the clamp to its closed position and thus squeeze or clamp the cable in desired position on the connector. Subsequent wire terminations and wire-trimming steps may be carried out in an automatic or semiautomatic manner by the use of equipment already known in the art.

Thus the cable is maintained in a fixed position relative to the clamp 10 and serves as a strain relief, preventing transmission of any axial force imparted to the cable 32 which would tend to result in disengagement between wires 34 and the metal contacts 36 of the connector 12.

It will be noted from FIG. 2 that intervals 44 are defined between opposed end walls 26 of the clamp 10 and adjacent edges 46 of the intermediate curved portion 38 and terminal portion 40. Such intervals provide space in which the cable 32 may be pulled downwardly relative to the curved edges 28 of the end walls 26 in the manner most clearly seen in FIG. 4 of the drawing. It will be further noted from FIG. 2 that the bending portion 37 between the arcuate portion 38 and the planar sidewall portion 36 is narrower than the sidewall planar portions 36 and 40 whereby bending action of the arcuate clamp portion 38 is facilitated.

FIG. 6 illustrates a preferred embodiment employing the teachings of this invention and which is more specifically described and claimed in the co-pending application of William H. McKee filed concurrently herewith entitled Cable Clamp and Hood Constructions For Use With Ribbon Connectors. In this embodiment a modified clamp 50 having a lower anchor portion 52 and an upper clamp portion 54 is adapted to mount the illustrated cable end segment 32 to an end portion of connector 12*a* having a metal shell reinforcement, the latter connector being of a type well-known in the prior art.

FIG. 7 is a top plan view of the connector 50 of FIG. 6 and more particularly shows central aperture 58 whereby the connector clamp may be secured to the planar end portion of connector 12*a* illustrated in FIG. 6 by means of illustrated rivet 60 of FIG. 6 or equivalent securing means. Clamp 50 of FIGS. 6 and 7 employs bendable clamping ears 62 extending from base 49 and having inwardly projecting detents 64 disposed on inner surfaces thereof. A cable-restraining detent rib 63 may be employed on base 49 to assist in preventing axial movement of cable 32 mounted in clamp portion 54. The outwardly diverging ears 62 may be urged into clamping engagement with interposed cable segment 32 in the manner illustrated in FIG. 8 by a simple squeezing-bending manipulation of the ears 62. Slots 66 disposed in sidewalls 68 of clamp 50, see FIG. 6, may be employed for purposes of engaging detents of a hood (not illustrated).

Clamp 50 may be readily formed from a blank stamped from a sheet or coil of low carbon steel approximately 0.047 inch thick. Steel bearing the description of The American Iron and Steel Institute "1010 annealed" has been found to function extremely well for the purposes herein described. The integral blank may be bent and formed into the configuration illustrated in FIGS. 6 through 8. Since a simple clamping action is all that is required to securely engage cable 32 for strain-relief purposes, the absence of usual securing straps, screws, etc. commonly used in the prior art renders this clamp well suited to automated assembly for the reasons above discussed relative to clamp 10.

A further preferred embodiment of the clamp of this invention comprises clamp 69 illustrated in FIG. 9, comprising an anchor portion 70 and a clamp portion 54*a* which is substantially the same as clamp portion 54 of FIG. 6. Portion 70 of clamp 69, however, is particularly adapted to be clampingly mounted on end portion 24 of connector 12 illustrated in FIG. 9. The anchor portion 70 has opposed downwardly extending clamping portions 72 adapted to clampingly engage opposed planar surfaces 74 of the connector end portion 24 (FIG. 9). C-shaped edge portions 76 of the clamp anchor portion 70 of the clamp 68 are adapted to slidably engage the opposed projections 78 of the connector 12 illustrated in FIG. 9. Whereafter edge portions 76 are clinched into locking engagement with surfaces 74. FIG. 11 illustrates the elements of FIG. 9 in a normal position of assembly. Mounting aperture 80 (FIG. 10) may be formed in anchor portion 70 of clamp 69 to align with connector aperture 22 (FIG. 9) if use of an additional or alternative securing means such as bolt 18 and nut 20 of FIG. 1 or rivet 60 of FIG. 8 is desired.

After clamp 69 is mounted in the connector end by means of clamp portion 72 as above described, and if desired by additional means such as rivet 60 of FIG. 8, cable 30 is placed on base 75 of clamp portion 54*a* with the sheath terminal end desirably in the plane of the juncture between the clamp anchor and clamp portions. The opposed clamp ears 62 are then bent or squeezed inwardly from the divergent relation of FIG. 9 to the parallel relation of FIG. 11. Simultaneously the cable 32 will be deformed from the circular cross-section of FIG. 9 to the substantially triangular cross-section of FIG. 11 where engaged by clamping ears 62*a*. Detents 64 disposed on such ears and rib 63*a* disposed on clamp base 75 are embedded in the soft sheath 30 of cable 32 to assist in effecting a firm interlock opposing relative movement between the cable and clamp. Clamp 69 is also preferably formed from an integral blank stamped from a sheet or coil of low carbon steel having the desired properties outlined above and obviously possesses the advantages of ease of formation and ease of assembly above described.

FIG. 12 illustrates a modification of clamp 10 of FIG. 1 in that a depending flange 80 is adapted to snugly engage inclined surface 82 of the connector end 24 as illustrated whereby rotational movement of the clamp on the connector end 24 is prevented.

It is thus seen from the foregoing description that a novel clamp of simplified construction has been provided which may be readily stamped as an integral unit, whereafter the same is formed into the respective clamp configuration. Such clamps may be readily assembled to an end portion of a ribbon-type connector of the type well-known in the art, whereafter the clamping wall portions may be formed into place by a simple deformation operation for locking an engaged portion of a cable in place thereon to serve the strain-relief function. It will be appreciated that each of the clamps is independent of a hood. Thereby the cable may be clamped either before or after the individual wires are terminated in the connector and, in any event prior to application of a hood or cover. Thus the terminations may be inspected prior to application of a hood and after the strain relief is effected.

The provided clamp may be employed with any appropriate hood construction, but preferably with a support hood such as that disclosed in the aforementioned copending McKee application filed concurrently herewith.

The provided clamps also may be employed wherever it is desired to provide a strain relief device without he necessity of an enveloping hood.

As above set forth the material of composition of such clamp is preferably of low carbon, soft steel which is readily deformed by a simple tool such as a pliers, and following deformation is fixed in place. The clamp, as above brought out in detail, requires no expensive tool for normal use thereof, may be readily stamped out and bent into appropriate configurations illustrated by simple bending operations. The clamping wall portions should be ductile, have no elastic memory, assuring cable retention in the final clamping position, and possess adequate strength to effect the desired retentions. Specific blank thickness dimensions and compositions of fabrication may be readily arrived at by those skilled in the art in the light of the above.

The foregoing description will make obvious to those skilled in the art a number of modified constructions which are within the ambit of the invention disclosed. This invention, therefore, is to be limited only by the scope of the invention as set forth in the appended claims.

What is claimed is:

1. A cable clamp for an electrical connector adapted to terminate conductors of such cable therein, said clamp being separate from the connector and comprising a base for mounting said clamp on a portion of such connector; deformable clamp means joined to said base for being formed against a cable outer periphery and clampingly engaging a peripheral portion of such cable to be clamped and retaining such engaged cable portion in relatively immovable relation relative thereto; said deformable clamp means being substantially nonresilient and of sufficient strength to prevent movement of an engaged cable relative thereto in the absence of discrete securing means.

2. The cable clamp of claim 1 wherein said means for engaging said cable is formed of a ductile material.

3. The cable clamp of claim 1 wherein said clamp is an integral metal element including portions forming said means for engaging such a cable, at least said last-mentioned means being formed of ductile metal.

4. The cable clamp of claim 3 wherein said last-mentioned means is deformable from a cable receiving position into a cable gripping position which is maintained by the inherent resistance to deformation of said metal forming said last-mentioned means.

5. The cable clamp of claim 1 in which the cable engaging means comprises a deformable clamp member connected to said base portion and adapted to move over said base portion and urge an engaged cable peripheral portion toward said clamp base portion.

6. The cable clamp of claim 5 in which end walls are joined to opposed ends of said clamp base portion and disposed adjacent opposite ends of said deformable clamp member; said walls having upper edges adapted to support a length of a cable adapted to be clamped.

7. The cable clamp of claim 6 in which said clamp member comprises a proximal planar portion joined to said clamp base portion and defining a side wall thereof intermediate said clamp end walls; and an arcuate portion contiguous with said planar portion adapted to be bent into overlying engagement with said clamp base portion generally along an axis defined by the juncture with said proximal planar portion.

8. The combination comprising, a cable clamp as in claim 1 and an electrical connector on which said cable clamp is mounted; said connector comprising a body of electrically insulating material having a plurality of wire-engaging contacts mounted therein for engagement with wires of a cable held by said clamp.

9. The combination of claim 8 in which said electrical connector is a solderless ribbon-type connector.

10. A cable clamp for an electrical connector adapted to terminate conductors of such cable therein, said clamp comprising a base portion for mounting on a portion of such connector, end walls extending from spaced portions of such base portion for supportably engaging spaced peripheral portions of such cable to be clamped in place by said clamp; deformable, substantially nonresilient clamping means for moving over said base portion and having opposed lateral edges spaced from said end walls so as to be positioned therebetween; said clamping means being movable from a position above the terminal edges of said end walls over said base portion toward said base portion whereby such cable supported on said end walls is urged toward said base portion with cable portions interposed said end walls being urged by said clamping means below the plane of said end wall distal edges, and such cable is locked in place in the absence of discrete securing means.

11. The combination comprising, a cable clamp as in claim 10 and an electrical connector on which said cable clamp is mounted; said connector comprising a body of electrically insulating material having a plurality of wire-engaging contacts mounted therein for engagement with wires of a cable held by said clamp.

12. combination of claim 11 in which said electrical connector is a solderless ribbon-type connector.

13. A method for effecting strain free terminations between conductors extending from a cable and contacts of an electrical connector by means of a clamp for mounting on a connector portion and having a deformable substantially nonresilient cable engaging clamp portion, comprising effecting terminations between the conductors and said connector contacts; and deforming the cable engaging clamp portion about a peripheral portion of said cable from which said conductors extend so as to lock the same to said clamp in the absence of discrete securing means whereby forces imparted to said cable will not be reacted to at the conductor-contact terminations when said clamp is mounted on said connector.

14. A method for effecting strain free terminations between conductors extending from a cable end and contacts of a an electrical connector by means of a clamp for mounting on a connector portion and having a substantially nonresilient, deformable cable-engaging clamp portion, comprising deforming the cable-engaging clamp portion about a peripheral portion of said cable from which said conductors extend so as to fixedly position said cable peripheral portions relative to said clamp in the absence of discrete securing means; and effecting terminations between the conductors and said connector contacts.

* * * * *